US005218918A

United States Patent [19]

Cline

[11] Patent Number: 5,218,918

[45] Date of Patent: Jun. 15, 1993

[54] CONVERTIBLE POWERBOAT

[76] Inventor: Charles G. Cline, 2919 Pheasant Dr., Casper, Wyo. 82604

[21] Appl. No.: 912,493

[22] Filed: Jul. 13, 1992

[51] Int. Cl.[5] ..... B63H 9/04

[52] U.S. Cl. ..... 114/56; 114/284; 114/343; 114/361; 440/37

[58] Field of Search ..... 440/37; 114/43, 56, 114/284, 287, 288, 343, 361

[56] References Cited

U.S. PATENT DOCUMENTS 2,855,885 10/1958 Thomas ..... 440/37

3,559,222 2/1971 Walker ..... 114/287

4,762,080 8/1988 Pearson ..... 114/343

4,932,839 6/1990 Pitchford ..... 440/37

*Primary Examiner*—Jesus D. Sotelo

*Attorney, Agent, or Firm*—Michael I. Kroll

[57] ABSTRACT

A convertible powerboat is provided which consists of a hull having a bow and a stern, a power source at the stern of the hull and a mechanism for altering the power source, so that it can be changed from an outboard motor boat to an air powered boat and vice versa. A hull module can also be installed to the underside of the hull to change the configuration of the hull.

10 Claims, 2 Drawing Sheets

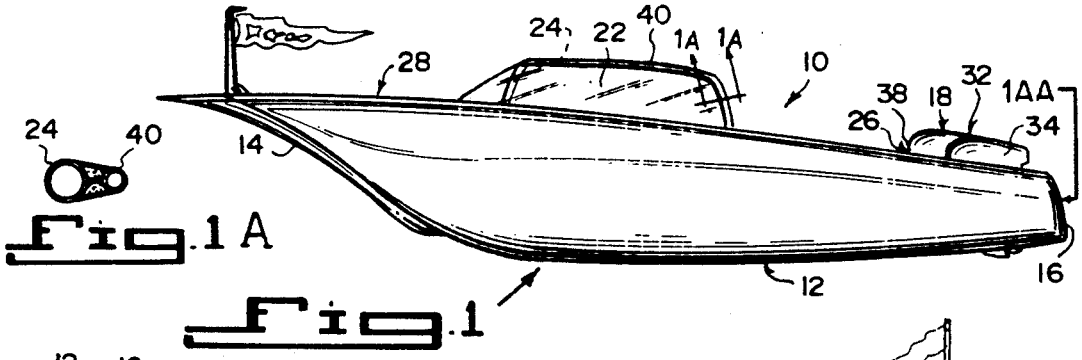
Fig. 1A
Fig. 1
Fig. 1AA
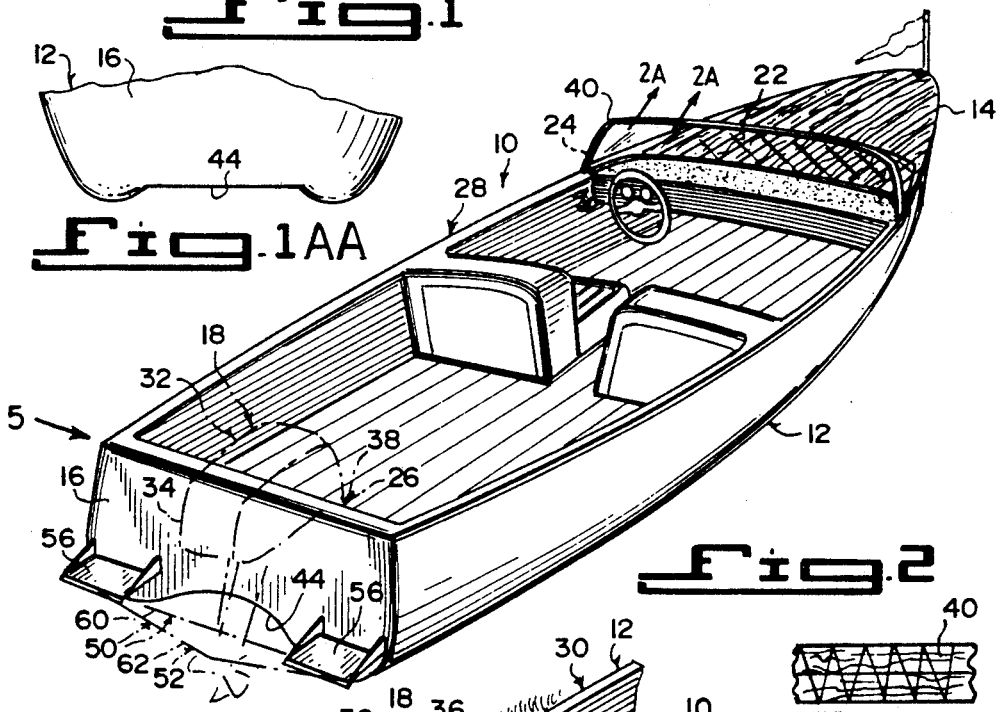
Fig. 2
Fig. 2A
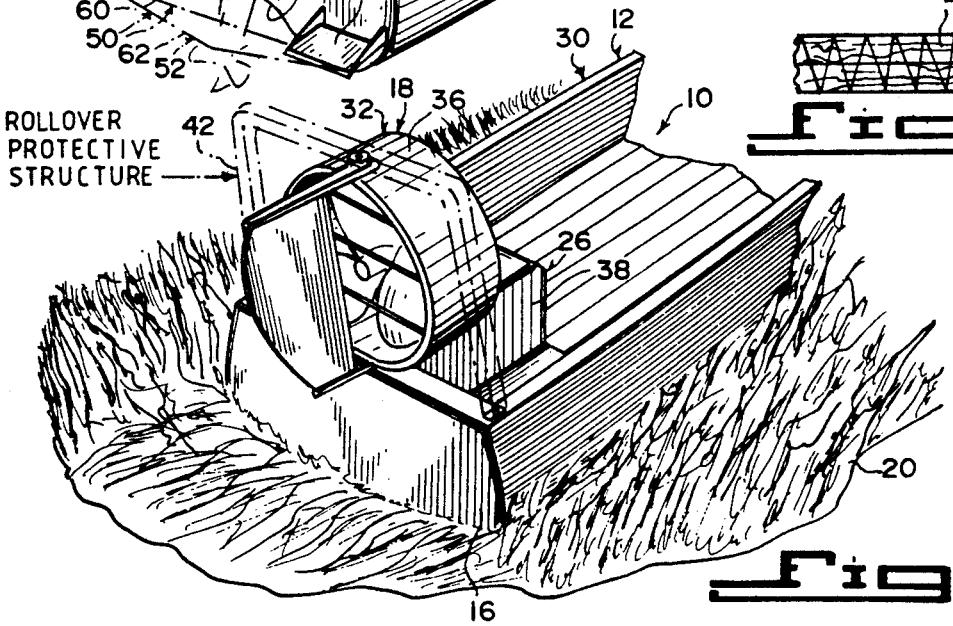
Fig. 3

(FLAT BOTTOM)

(V BOTTOM)

CONVERTIBLE POWERBOAT

BACKGROUND OF THE INVENTION

1. Field of the Invention

The instant invention relates generally to watercraft and more specifically it relates to a convertible powerboat.

2. Description of the Prior Art

Numerous watercraft have been provided in prior art that are adapted to be utilized to travel along a body of water and have a standard hull configuration to perform a single function. While these units may be suitable for the particular purpose to which they address, they would not be as suitable for the purposes of the present invention as heretofore described.

SUMMARY OF THE INVENTION

A primary object of the present invention is to provide a convertible powerboat that will overcome the shortcomings of the prior art devices.

Another object is to provide a convertible powerboat that can have its hull configuration altered by the installation of various types of modules to the underside of the hull, so as to change it into a flat bottom hull, a V-shaped hull, a tri-hull or a hydro-foil hull.

An additional object is to provide a convertible powerboat that can be changed from an outboard motor boat to an air powered boat by removing the outboard engine and replacing it with an air drive engine with a roll over protective structure.

A further object is to provide a convertible powerboat that is simple and easy to use.

A still further object is to provide a convertible powerboat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the instant invention being a powerboat in the form of an outboard motor boat.

FIGURE 1A is a cross sectional view taken along line 1A—1A in FIG. 1, showing a roll over protective cover on the windshield frame in greater detail.

FIGURE 1AA is a diagrammatic rear view with parts broken away taken in direction of arrow 1AA in FIG. 1.

FIG. 2 is a rear perspective view of the instant invention being a boat in the form of a snow and ice boat.

FIG. 2A is a cross sectional view taken along line 2A—2A in FIG. 2 of the roll over protective cover on the windshield frame in great detail.

FIG. 3 is a rear perspective view with parts broken away of the instant invention, in which the powerboat is in the form of an air powerboat.

Figure 3A:
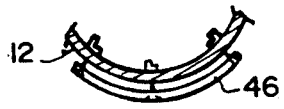

FIG. 3A is a diagrammatic cross sectional view of a portion of the hull showing a plastic liner to be secured thereto.

Figure 4:
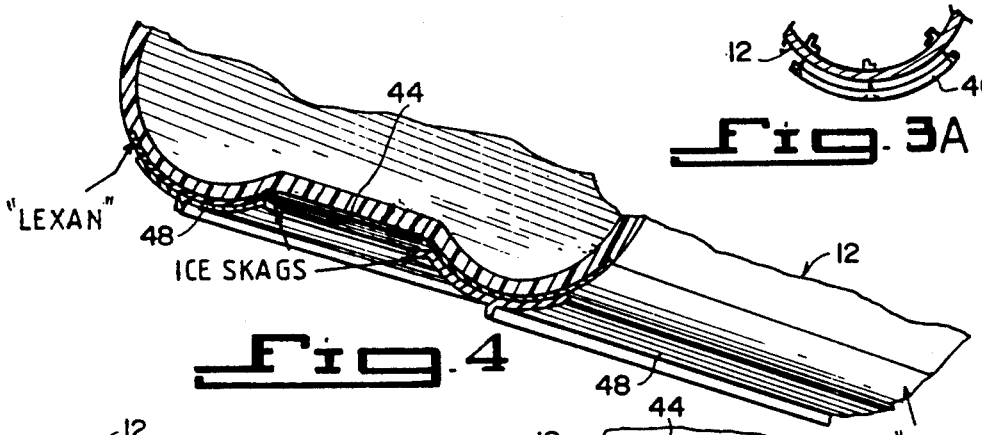

FIG. 4 is a cross sectional perspective view of a portion of the hull showing a pair of ice skags connected thereto.

Figure 4A:
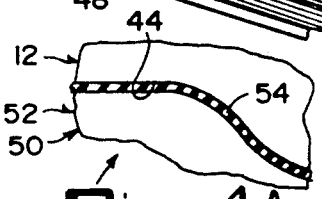

FIG. 4A is a diagrammatic cross sectional view showing a portion of the hull and a hull module with a rubber gasket therebetween.

Figure 5:
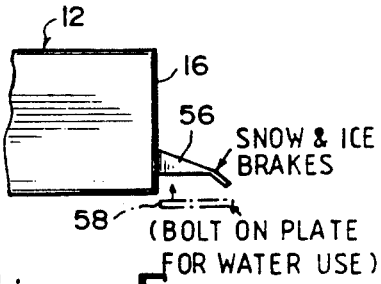

FIG. 5 is a side view with parts broken away taken in direction of arrow 5 in FIG. 2, showing one of the snow and ice brakes extending from the stern of the hull.

Figure 6:
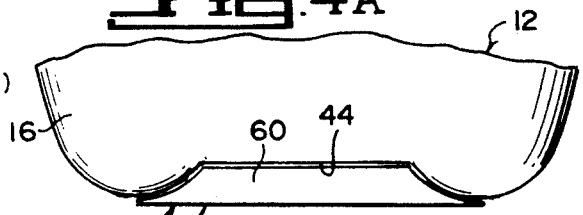

FIG. 6 is a diagrammatic rear view similar to FIG. 1AA showing a flat bottom hull module being attached to the underside of the hull.

Figure 6A:
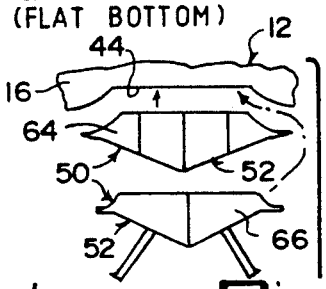

FIG. 6A is a diagrammatic rear view similar to FIG. 6 showing a tri-hull module and a hydro-foil hull module, which can be attached to the underside of the hull.

Figure 7:
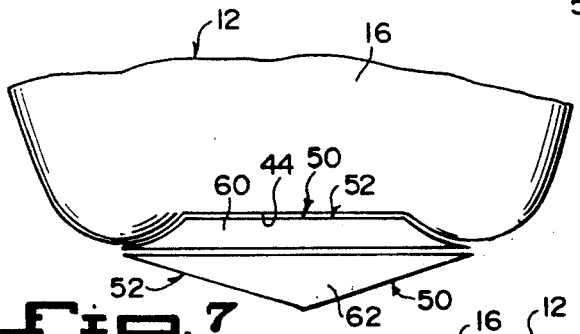

FIG. 7 is a diagrammatic rear view similar to FIG. 6 showing a V-shaped hull module being attached to the underside of the flat bottom hull module at the underside of the hull.

Figure 8:
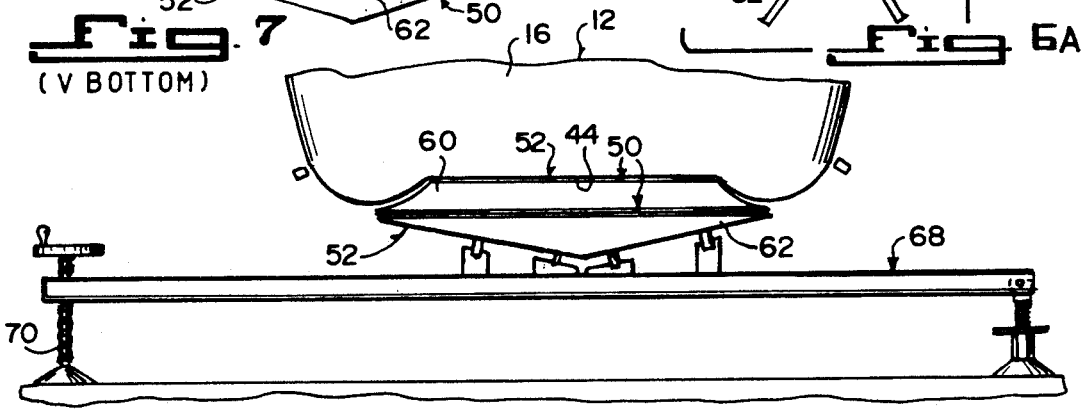

FIG. 8 is an elevational view showing a trailer used in conjunction with the instant invention.

DETAILED DESCRIPTION OF THE PREFERRED EMBODIMENTS

Turning now descriptively to the drawings, in which similar reference characters denote similar elements throughout the several views, the Figures illustrate a convertible powerboat 10 which consists of a hull 12 having a bow 14 and a stern 16. A power source 18 is at the stern 16 of the hull 12 to drive the hull 12 along a body of water 20. A windshield 22 with frame 24 is mounted to the hull 12 near the bow 14. A mechanism 26 is for altering the power source 18, so that the powerboat 10 can be changed from an outboard motor boat 28 to an air powered boat 30 and vice versa. The mechanism 26 is a converter which provides mounting for either the outboard motor or the air powered motor and vice versa.

The power source 18 is an engine 32 to drive the hull 12 along the body of water 20. The engine 32 is an outboard type 34, shown in FIGS. 1 and 2, and an air drive type 36, shown in FIG. 3. The altering mechanism 26 is a removable mount 38 for the outboard type engine 34 and the air drive type engine 36. A roll over protective cover 40 is secured to the frame 24 of the windshield 22. A roll over protective structure 42 is mounted to the stern 16 of the hull 12 about the air drive type engine 36, to act as a fan guard when the powerboat 10 is altered to the air powered boat 30. In case of a roll over onto a hard surface, some degree of protection will be given to people within the powerboat 10.

The hull 12 has a longitudinal shallow bottom depression 44 to present a degree of surface clearance for operation on ice and for flotation on the body of water at low and moderate speeds. At higher speeds it will rise out of the body of water 20, so as to decrease the possibility of serious damage in case of collision with a solid object at the surface of the body of water 20.

A pair of durable liners 46 are each mounted to the underside of the hull 12 on opposite sides of the shallow bottom depression 44 to provide wear protection to the hull 12, while being operated on the ice and also structural integrity, should the hull 12 strike a solid object.

A pair of ice skags 48 can each be mounted to the underside of the hull 12 on opposite sides of the shallow bottom depression 44 to provide directional stability to the hull 12 while under power on the ice, as well as when the hull 12 lies at rest in a high wind area. The ice skags 48 will serve for structural integrity and to act as an extra wear protection for operations intermediate between water and ice since the transition from water to ice is abrasive to the hull 12.

The convertible powerboat 10 also contains a mechanism 50 for changing the configuration of the hull 12. The hull changing mechanism 50 is a hull module 52, which can be installed to the underside of the hull 12 at the shallow bottom depression 44 to increase structural integrity of the hull 12. If the hull module 52 strikes a hard object in the water it will reduce damage directly to the hull 12. A rubber gasket 54 is integral on the hull module 52, where it comes into contact with the hull 12, so as to dampen vibration and retard wear.

A pair of snow and ice brakes 56 are spaced apart and mounted to extend from the stern 16 of the hull 12, so that they may be used simultaneously to bring the hull 12 to a complete stop. They may be used separately to provide directional assistance and they may also be used for a footing, which is vital for a through the ice search and rescue operation. Each snow and ice brake 56 includes a water brake plate 58 which can be bolted thereto, so that the water brake plate 58 can be used individually to counteract the roll action when the powerboat 10 is an air powered boat 30, since an air powered boat 30 tends to roll over when the power is cut in a turn.

The hull module 52 can be in a flat bottom hull configuration 60, as shown in FIG. 6. The hull module 52 can be in a V-shaped hull configuration 62 attached to and used in conjunction with the flat bottom hull configuration 60, as shown in FIG. 7. The hull module 52 can be in a tri-hull configuration 64, as shown in FIG. 6A. The hull module 52 can also be in a hydro-foil hull configuration 66, also shown in FIG. 6A. The convertible powerboat 10 further includes a trailer 68 having a jack 70 on its front end and rear end to raise and lower the hull module 52 with respect to the underside of the hull 12 for installation thereof.

LIST OF REFERENCE NUMBERS

10: convertible powerboat
12: hull of 10
14: bow of 12
16: stern of 12
18: power source
20: body of water
22: windshield
24: frame of 22
26: altering mechanism
28: outboard motor boat
30: air powered boat
32: engine
34: outboard type for 32
36: air drive type for 32
38: removable mount
40: roll over protective cover on 24
42: roll over protective structure at 16
44: longitudinal shallow bottom depression on 12
46: durable liner
48: ice skag
50: hull changing mechanism
52: hull module for 50
54: rubber gasket
56: snow and ice brake on 16
58: water brake plate bolted to 56
60: flat bottom hull configuration for 52
62: V-shaped hull configuration for 52
64: tri-hull configuration for 52
66: hydro-foil hull configuration
68: trailer
70: jack on 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A convertible powerboat which comprises:

a) a hull having a bow and a stern;

b) a power source at the stern of said hull to drive said hull along a body of water, said power source is an engine to drive said hull along the body of water, said engine is an air drive;

c) a windshield with frame mounted to said hull near said bow;

d) means for altering said power source, so that said powerboat can be changed from an outboard motor boat to an air powered boat and vice versa, said altering means is a removable mount for an outboard engine or said air drive engine;

e) a roll over protective cover secured to said frame of said windshield; and f) a roll over protective structured mounted to the stern of said hull about said air drive engine to act as a fan guard when said powerboat is altered to said air powered boat, so that in case of a roll over a hard surface, some degree of protection will be given to people within said powerboat.

2. A convertible powerboat which comprises:

a) a hull having a bow and a stern, said hull having a longitudinal shallow bottom depression to present a degree of surface clearance for operation on ice and for flotation on the body of water at low and moderate speeds, while at higher speeds it will rise out of the body of water, so as to decrease the possibility of serious damage in case of collision with a solid object at the surface of the body of water;

b) a power source at the stern of said hull to drive said hull along a body of water, said power source is an engine to drive said hull along the body of water, said engine is an air drive;

c) a windshield with frame mounted to said hull near said bow;

d) means for altering said power source, so that said powerboat can be changed from an outboard motor boat to an air powered boat and vice versa, said altering means is a removable mount for an outboard engine or said air drive engine;

e) a roll over protective cover secured to said frame of said windshield;

f) a roll over protective structure mounted to the stern of said hull about said air drive engine to act as a fan guard when said powerboat is altered to said air powered boat, so that in case of a roll over onto a hard surface, some degree of protection will be given to people within said powerboat;

g) a pair of durable liners, each mounted to the underside of said hull on opposite side of said shallow bottom depression to provide wear protection to said hull, while being operated on the ice and also structural integrity, should said hull strike a solid object;

h) a pair of ice skags, each mounted to the underside of said hull on opposite sides of said hallow bottom depression to provide directional stability to said hull while under power on the ice, as well as when said hull lies at rest in a high wind area, so that said ice skags will serve for structural integrity and to act as an extra wear protection for operations intermediate between water and ice, since the transition from water to ice is abrasive to said hull; and i) means for changing the configuration of said hull, said hull changing means is a hull module, which can be installed to the underside of said hull at said shallow bottom depression to increase structural integrity of said hull and if said hull module strikes a hard object in the water it will reduce damage directly to said hull.

3. A convertible powerboat as recited in claim 2, further including a rubber gasket integral on said hull module where it comes into contact with said hull, so as to dampen vibration and retard wear.

4. A convertible powerboat as recited in claim 3, further including a pair of snow and ice brakes spaced apart and mounted to extend from the stern of said hull, so that they may be used simultaneously to bring said hull to a complete stop, they may be used separately to provide directional assistance and they may also be used for a footing, which is vital for a through the ice search and rescue operation.

5. A convertible powerboat as recited in claim 4, wherein each said snow and ice brake includes a water brake plate which can be bolted thereto, so that said water brake plate can be used individually to counteract the roll action when said powerboat is an air powered boat, since an air powered boat tends to roll over when the power is cut in a turn.

6. A convertible powerboat as recited in claim 1, wherein said hull module is a flat bottom hull configuration.

7. A convertible powerboat as recited in claim 6, wherein said hull module is a V-shaped hull configuration attached to and used in conjunction with said flat bottom hull configuration.

8. A convertible powerboat as recited in claim 2, wherein said hull module is a tri-hull configuration.

9. A convertible powerboat as recited in claim 2, wherein said hull module is a hydro-foil hull configuration.

10. A convertible powerboat as recited in claim 2, further including a trailer having a jack on its front end and rear end to raise and lower said hull module with respect to the underside of said hull for installation thereof.

* * * * *